US005208576A

United States Patent [19]

Wunderlich et al.

[11] Patent Number: 5,208,576

[45] Date of Patent: May 4, 1993

[54] ELECTRICAL EXTERNAL RESISTANCE

[75] Inventors: Dieter Wunderlich, Selb; Ernst Karich, Naila-Lippertsgrun; Claus Degel, Hof, all of Fed. Rep. of Germany

[73] Assignee: Draloric Electronic GmbH, Selb, Fed. Rep. of Germany

[21] Appl. No.: 694,118

[22] Filed: May 1, 1991

[30] Foreign Application Priority Data

May 2, 1990 [DE] Fed. Rep. of Germany ..... 4014104

[51] Int. Cl.[5] ..... H01C 1/028

[52] U.S. Cl. ..... 338/248; 338/113; 338/204; 338/205; 338/250; 338/253; 338/254; 338/314

[58] Field of Search ..... 338/230, 275, 276, 314, 338/312, 250, 252, 253, 254, 113, 93, 204, 205, 248, 20

[56] References Cited

U.S. PATENT DOCUMENTS 4,419,564 12/1983 Marcoux ..... 338/22 R X

FOREIGN PATENT DOCUMENTS 3715860 5/1987 Fed. Rep. of Germany .

3814987 5/1988 Fed. Rep. of Germany .

*Primary Examiner*—Marvin M. Lateef

*Attorney, Agent, or Firm*—Zarley, McKee, Thomte, Voorhees, & Sease

[57] ABSTRACT

An electrical external resistor with a plate-like, electrical insulating carrier element and a flat resistance element arranged on the upper side of the carrier element. The carrier element has several films forming a closed coating and varying in their electrical conductivity. The films arranged on the upper side and on the lower side of the carrier element consist of cermet, and the film covering the edge area of the carrier element consists of an electrically insulating material. By means of springs or a pressure distribution plate, the resistance element is pressed against the upper cermet film of the carrier element. The interior space of the housing is filled with a casting compound made of addition cross-linking two-component silicon caoutchouc (rubber). The electrical external resistance is discharge-free.

23 Claims, 4 Drawing Sheets

ELECTRICAL EXTERNAL RESISTANCE

FIELD OF THE INVENTION

The invention relates to an electrical external resistance with a plate-like, electrically insulating carrier element, which, on its underside, has an electrically conductive film and with a resistance element having a plane surface, which is arranged on the upper side of the carrier element, wherein a circular edge area of the carrier element is not covered by the resistance element.

DESCRIPTION OF THE PRIOR ART

Such an external resistance is known from DE-OS 37 15 860. With this electrical external resistance, the underside of the carrier element is coated with an electrically conductive paint, containing fillers, such as carbon or silver. On the upper side of the carrier element, the external resistance element is applied in the form of a foil, a thin film or a thick film. The resistance element and the carrier element are essentially arranged inside a housing having an electrically nonconductive upper section and an electrically conductive lower section which is tightly connected with the upper section by means of screws extending through the carrier element, wherein the carrier element is inserted between the upper section and the lower section of the housing. The upper portion of the housing rests directly on the uncoated edge area of the carrier element, while the electrically conductive film on the underside of the carrier element is in contact with the surface of the lower section of the housing. A hollow space in the housing, formed above the carrier element and the resistance element, is partially filled with an electrically insulating compound, which is in contact with the uncoated edge area of the carrier element. Thus, the surface of the carrier element is coated only partially and the uncoated surface of the carrier element is in contact with the insulating compound, the upper section of the housing, the air on the outside of the housing and with the screws connecting the upper section with the lower section of the housing. In this way, undesirable partial discharges can occur at these contact points. Also, the electrically conductive paint, applied to the underside of the carrier element, cannot prevent partial discharges. For this reason, the known electrical external resistance has partial breakdown discharge voltages of 1 kV to 2 kV for partial discharges <5 pC. Also, the known external resistance has only a small surface loading capacity of approximately 10 to 15 Watt/cm$^2$.

An electrical external resistance of the initially described type is also known from DE-OS 38 14 987. With this external resistance, the carrier element consists of at least two insulating films, arranged on top of each other, between which a flat temperature equalizing element of a heat-conducting material is provided, wherein the temperature equalizing element and the accompanying insulating films join. The temperature equalizing element is smaller than the insulating films, resulting in exposed surface sections of the insulating films. A casting compound is equally in direct contact with the exposed surface sections of the insulating films. The resistance element may be applied to the upper side of the uppermost insulating film of the carrier element in the form of a thick film of cermet. Also, with this electrical external resistance, the partial breakdown discharge voltages are small and also lie in the range of 1 kV to 2 kV for partial discharges <5 pC. Furthermore, this electrical external resistance also has a small (low) surface loading capacity of approximately, 25 Watt/cm$^2$.

SUMMARY OF THE INVENTION

It is the task of the invention to construct the electrical external resistance of this type in such a way that with a surface loading capacity which is higher than that of the previously known external resistances, it is discharge-free, wherein the discharge-free state in the case of partial breakdown discharge voltages of >5 kV for partial discharges is given at <5 pC.

The task of the invention is solved in that in the case of an electrical external resistance of this type, the carrier element is surrounded by several films, forming a closed cover and having different electrical conductivity properties, of which at least the electrically conductive film applied to the upper side of the carrier element consists of cermet and the film covering the edge area of the carrier element consists of an electrically insulating material.

The external resistance of the invention has a high surface loading capacity of approximately 50 Watt/cm$^2$ with partial breakdown discharge voltages of >5 kV for partial discharges <5 pC. Its admissible continuous operating voltage is greater than 5 kV, since no destructive partial discharges occur.

Advantageous further developments of the invention are the object of the subclaims 2 to 18.

DESCRIPTION OF THE DRAWINGS

Various examples of the invention are shown in the drawings and are further described in the following. It is shown in FIG. 1 a cross section through an electrical external resistance in accordance with a primary example of the invention, FIG. 2 a cross section through an electrical external resistance in accordance with a second example of the invention, FIG. 3 a cross section through an electrical external resistance in accordance with a third example of the invention, FIG. 4 a cross section through an electrical external resistance in accordance with a fourth example of the invention.

DESCRIPTION OF THE PREFERRED EMBODIMENTS

Figure 1:
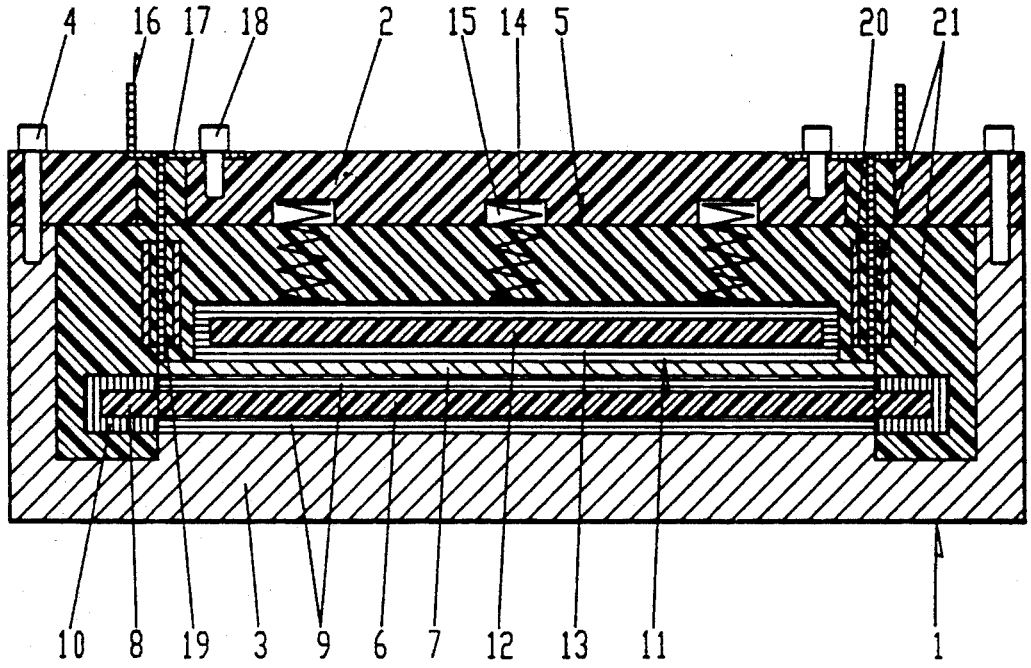

In the drawings, the same or corresponding parts of the electrical external resistances shown are described with the same reference numbers.

The electrical external resistance shown in FIG. 1 has a housing (1), consisting of an upper section (2) and a lower section (3), which is connected with the upper section (2) by means of screws (4) or other mechanical fastening elements, such as rivets, extending through the upper section (2) and the lower section (3) outside an interior space (5) formed in the housing (1). The lower section (3) is quite heat-conductive and consists of a metal or a metal alloy, such as aluminum, copper, brass or similar materials. The upper section (2) of the housing consists of an electrically insulating material, whereby it is rendered voltage-free. The upper section of the housing may be produced, for example, from the following materials: glazed ceramics, creep-resistant thermo- and duroplastics, which are TE-free (TE is the abbreviation for partial discharge), for example polyamide reinforced, polycarbonate, melamine resin reinforced, epoxy resin reinforced, polyphenylene sulfide or -oxide.

In the interior space (5) of the housing (1), a plate-like, electrically insulating carrier element (6) of a ceramic material, such as aluminum oxide, beryllium oxide, aluminum nitride, and a resistance element (7) are provided, which is arranged on the upper side of the carrier element (6). A surrounding edge area (8) of the carrier element (6) remains uncovered by the resistance element (7).

In the example of the invention shown in FIG. 1, the resistance element (7) consists of a metal foil, formed by a meandering strip.

The carrier element (6) has on both its upper and its lower side a film (9) of cermet. The cermet films (9) are electrically conductive and have a resistance ranging from 1 kΩ to 50 MΩ. The surface of the cermet films (9) is very smooth, i.e., substantially smoother than the surface of the uncoated carrier element (6). Furthermore, the cermet films (9) are gas-tight and there are no hollow spaces in the cermet films (9) or between the cermet films (9) and the carrier element (6).

The cermet films (9) are produced with the cermet applied in a silk screen process to the carrier element (6) in the form of a paste and is sintered after drying. The cermet paste contains precious metals or their oxides, such as ruthenium, and can be commercially obtained, as a resistance paste, for example, from the Du Pont company under the name "HS80."

The surrounding edge area (8) of the carrier element (6) is not covered by the cermet films (9). The edge area (8) of the carrier element (6) is, however, coated with an electrically insulating glaze (10) which has a specific resistance of $>10^5$ ⅛m. The glaze (10) also has a very smooth surface, is gas-tight, has no hollow spaces and is connected with the carrier element (6) without the presence of hollow spaces. The glaze (10) joins without interruption to the cermet films (9), so that the glaze (10), together with the cermet films (9), form a closed coating extending around the carrier element (6).

The lower cermet film (9) is in contact with the lower section (3) of the housing, while the upper cermet film (9) is in contact with the resistance element (7). Above the resistance element (7), a pressure distribution plate (11) is located which is smaller than the carrier element (6) and which has a basic element (12) made of a ceramic material, such as aluminum oxide, which is surrounded by a film (13) of cermet.

Several pressure springs (14), arranged at a distance from each other, are distributed across the surface of the pressure distribution plate (11). With their upper ends, the pressure springs (14) are supported on the upper portion of the housing (2), and with their lower ends, they act upon the upper side of the pressure distribution plate (11), so that the pressure distribution plate (11) is pressed against the resistance element (7) and hence the resistance element (7) is pressed against the upper cermet film (9) of the carrier element (6). The upper ends of the pressure springs (14) are arranged in depressions (15), which are formed in the upper section of the housing (2), so that the springs (14) are secured against lateral sliding.

At the upper side of the upper section (2) of the housing, two contacts (16) for the outside electrical connection of the external resistance are attached. The contacts (16) consist each of a angular element having an arm (17) extending parallely to the upper side of the upper section (2) of the housing and connected to the upper section (2) of the housing by means of a screw (18) or another mechanical fastening element, such as a rivet. Through the arrangement of the arms (17) of the contact (16) in a depression inside the upper section (2) of the housing, the contact (16) cannot be turned about the axis of the screw (18). The contacts (16) are connected with the resistance element (7) by means of electrical lines (19), each of which is guided through a bore hole inside the upper section (2) of the housing. Pulling and compressive forces to which the contacts (16) may be subjected are transferred by the contacts (16) only to the upper section (2) of the housing and not to the electrical lines (19).

Each of the lines (19) is surrounded by an insulating silicone tube (20), wherein between each line (19) and the accompanying silicone tube (20) an annular space is located, which is filled with a casting compound (21).

Also the interior oh amber (5) of the housing (1) is filled with the casting compound (21), so that all structural elements of the resistance located inside the interior chamber (5) are surrounded by the casting compound (21). Only between the lower cermet film (9) and the lower section (3) of the housing and in the depressions (15) no casting compound (21) is located.

The casting compound (21) consists of a solvent-free, filler-free addition crosslinking two-component silicone caoutchouc (rubber) mass of the RTV-type. It has a high degree of temperature stability >250° C., a high insulation stability >25 kV/mm, a very good heat conductivity of 0.2 Watt/mK and an extremely good wettability and cohesiveness at the adjoining surfaces. The casting compound (21) is absolutely TE-free (discharge-free) up to the breakdown voltage.

Figure 2:
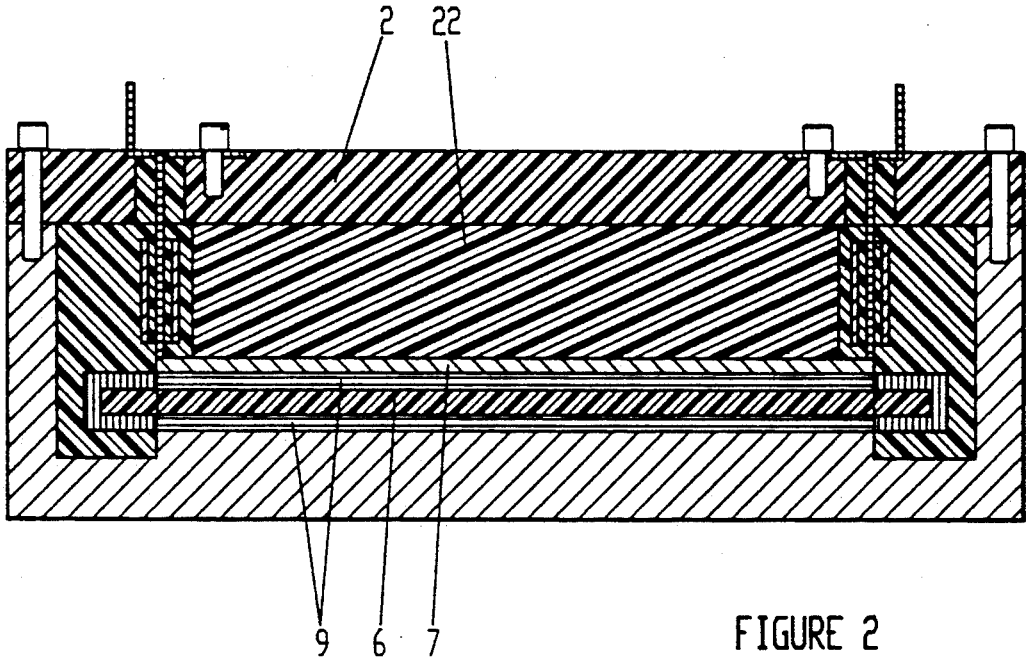

The electrical external resistance shown in FIG. 2 in accordance with a second example of the invention distinguishes itself from the external resistance shown in FIG. 1 only in that in the place of the pressure distribution plate (11) and of the springs (14), an elastically deformable pressure pad (22) made of silicone caoutchouc is provided. The pressure pad (22) is elastically compressed by the upper section (2) of the housing, at which point it supports itself with its upper surface on the upper section (2) of the housing and, with its lower surface, acts upon the resistance element (7), which subsequently is pressed against the upper cermet film (9) of the carrier element (6). The silicone caoutchouc of the pressure pad (22) has a defined conductivity with a specific resistance in the range $>10^3$ Ωm$<10^7$ Ωm.

Figure 3:
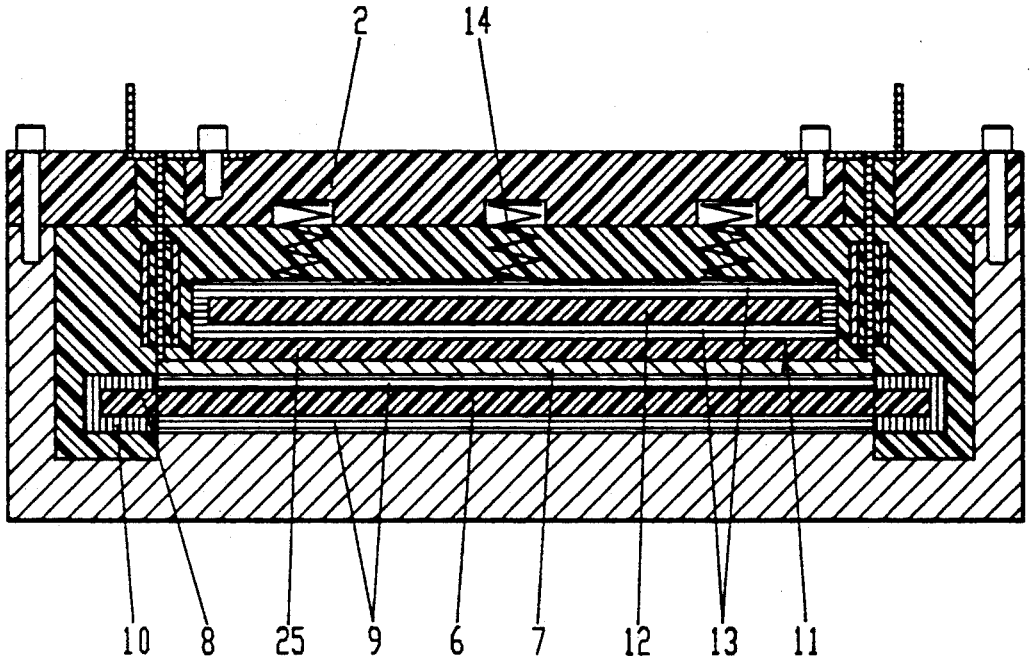

The electrical external resistance shown in FIG. 3, in accordance with a third example, coincides with the electrical external resistance shown in FIG. 1 in that the resistance element (7) is arranged between the plate-like carrier element (6), which on its upper side and its lower side has a cermet film (9) and an edge area (8), coated with a glaze (10), and the pressure distribution plate (11), consisting of a ceramic base element (12), which is surrounded by a cermet film (13).

In contrast to the external resistance shown in FIG. 1, with the external resistance shown in FIG. 3, the pressure distribution plate (11) and the plate-like carrier element (6) are kept contact-free at a distance by means of an elastically deformable pressure response pad (25), made of a conductive silicone caoutchouc. The pressure response pad (25) rests with its upper surface against the lower surface of the cermet film (13) of the pressure distribution plate (11) and acts upon the resistance element (7) with its lower surface, so that the resistance element (7) is pressed against the upper cermet film (9) onto the carrier element (6).

The pressure build-up takes place by means of springs (14), which are arranged at a distance from each other by the pressure distribution plate (11). With their lower end, they act upon the upper surface of the cermet film (13) of the pressure distribution plate and with their upper ends support themselves against the upper section (2) of the housing.

Figure 4:
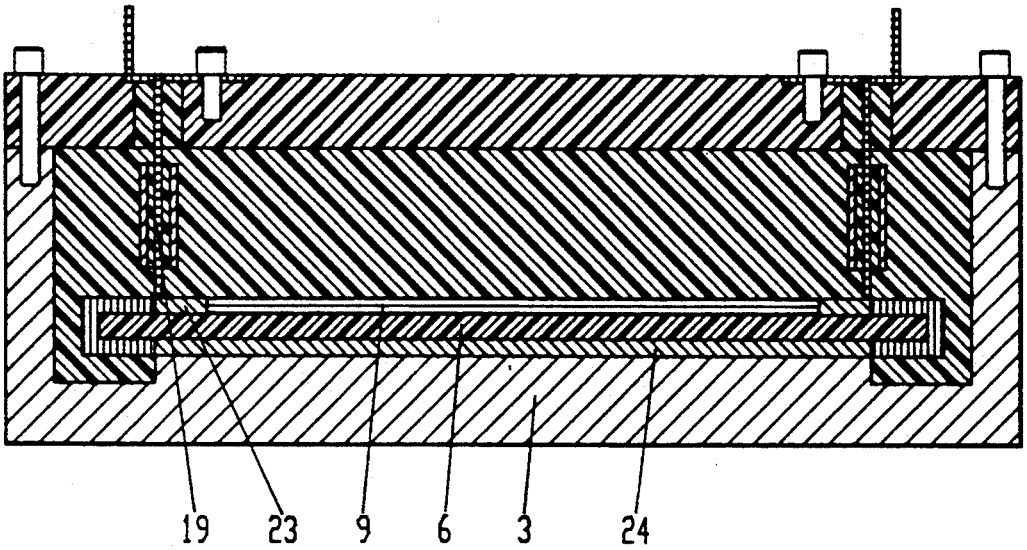

The electrical external resistance in accordance with a fourth example of the invention, as shown in FIG. 4, distinguishes itself from the electrical external resistances shown in FIGS. 1, 2 and 3 in particular in that no separate resistance element, pressed to the upper cermet film (9) of the carrier element (6) is used, but in that the resistance element is the cermet film (9) itself, applied to the upper side of the carrier element (6). Thus, the cermet film (9) represents a thick film resistance. At the opposing ends of the cermet film (9), serving as a resistance element, two connection coatings (23) are located on the upper side of the carrier element (6), wherein these connection coatings (23) may consist, for example, of an alloy of Ag and Pd. With these connection coatings (23), the electrical lines (19) are soldered. On the underside of the carrier element (6), no cermet film is provided but a metal alloy film (24), such as Ag/Pd, which is soldered with the lower section (3) of the housing.

With all four variations of the electrical external resistance, the edge area (8) of the carrier element (6) is coated with a glaze. In the place of this glaze, also a film with a suitable coupling agent for the casting compound may be provided.

The electrical external resistances of the invention may be used for high voltage transmission arrangements, monoverters three phase alternating current frequency converters, buffer resistors for thyristors, etc., wherein a discharge-free state is particularly desirable.

We claim:

1. An electrical resistor comprising:

a plate-like electrically insulating carrier element having a lower surface, an upper surface and an edge area surrounding said upper and lower surfaces;

a coating covering said carrier element and comprising a first film consisting of an electrically conductive material and applied to said lower surface of said carrier element, a second film consisting of cermet and applied to said upper surface of said carrier element, and a third film consisting of an electrically insulating material and applied to said edge area of said carrier element;

a flat resistance element; and means for pressing said resistance element into contact with said second film.

2. An electrical resistor in accordance with in claim 1 wherein said electrically conductive material of said first film is cermet.

3. An electrical resistor comprising:

a plate-like electrically insulating carrier element having a lower surface, an upper surface and an edge area surrounding said upper and lower surfaces;

a flat resistance element;

a coating covering said carrier element and comprising a first film consisting of an electrically conductive material and applied to said lower surface of said carrier element, a second film consisting of cermet and applied to said upper surface of said carrier element, and a third film consisting of an electrically insulating material and applied to said edge area of said carrier element; and said second film constituting said flat resistance element.

4. An electrical resistor in accordance with claim 3 wherein said second film has two opposed ends and said coating includes a pair of electrically conductive connector films each being applied to said upper surface of said carrier element at a respective one of said opposed ends of said second film.

5. An electrical resistor in accordance with in claim 4 wherein each of said connector films consists of metal.

6. An electrical resistor in accordance with claim 4 wherein each of said connector films consists of a metal alloy.

7. An electrical resistor in accordance with claim 6 wherein said metal alloy comprises Ag and Pd.

8. An electrical resistor in accordance with claim 3 wherein said first film consists of metal.

9. An electrical resistor in accordance with claim 3 wherein said first film consists of a metal alloy.

10. An electrical resistor in accordance with claim 9 wherein said metal alloy comprises Ag and Pd.

11. An electrical resistor in accordance with claim 3 further comprising a housing for accommodating the carrier element and the resistance element, and having a heat-conducting lower housing section with which the first film is in heat-conducting contact, the lower section of the housing consisting of metal or a metal alloy.

12. An electrical resistor in accordance with claim 11 wherein the first film is soldered with the lower housing section.

13. An electrical resistor in accordance with claim 11 wherein the housing has an electrically insulating upper housing section rigidly connected with the lower housing section and wherein a space between the housing, the carrier element and the resistance element is filled at least partially with an electrically insulating casting compound consisting of an addition cross-linking two-component silicone caoutchouc mass.

14. An electrical resistor in accordance with claim 13 wherein the resistance element is connected with two electrical external contacts attached at the upper housing section by means of two electrical lines extending through the upper housing section, the electrical lines each being surrounded by a tube made of an electrically insulating material, with an annular space being present between the tube and the respective electrical line, the space being filled with casting compound.

15. An electrical resistor in accordance with claim 11 wherein the housing has an electrically insulating upper housing section which is rigidly connected with the lower housing section and wherein the resistance element is connected with external contacts attached to the upper housing section by means of two electrical lines extending through the upper housing section, the eternal contacts being secured to the upper housing section by means of mechanical fastening elements.

16. An electrical resistor in accordance with claim 15 wherein the upper housing section has an outer surface with a depression therein, and wherein each external contact has a portion forming an angle with an elongated arm extending parallel to the outer surface of the upper housing section and being arranged in the depression in the outer surface of the upper housing section and is attached to the upper housing section by fastening means.

17. An electrical resistor in accordance with claim 3 wherein a housing accommodates the carrier element and the resistance element, the housing having an upper section and a lower section connected with the upper section, the resistance element being urged by means of spaced pressure springs against the film of cermet, the springs supporting themselves with their ends engaging a pressure distribution plate which rests directly against the resistance element

18. An electrical resistor, in accordance with claim 17 characterized in that the pressure distribution plate has a basic element made of an electrically insulating ceramic material which is coated completely around with cermet.

19. An electrical resistor in accordance with claim 3 wherein a housing accommodates the carrier element and the resistance element, the housing having connected upper and lower sections, the resistance element being urged against the film of cermet by an elastically deformable pressure transfer pad.

20. An electrical resistor in accordance with claim 3 wherein a housing accommodates the carrier element and the resistance element, and has an upper section and a lower section connected with the upper section, the resistance element being pressed by means of an elastically deformable pressure pad against the second film, the pressure pad being supported against the upper housing section and consisting of an electrically conductive silicone caoutchouc with a specific resistance being $>10^3\Omega m$ and $<10^7\ \Omega m$.

21. An electrical resistor in accordance with claim 3 wherein the electrically third film is a glaze having a specific resistance of $>10^5\ \Omega m$.

22. An electrical resistor in accordance with claim 3 wherein the first and second films have a resistance in the range of 1 k to 50 MΩ.

23. An electrical resistor in accordance with claim 3 wherein the ratio of the resistance values of the resistance element and the first and second films are 1:10 to 1:1,000,000.

* * * * *